US005248099A

United States Patent [19]

Lahner et al.

[11] Patent Number: 5,248,099

[45] Date of Patent: Sep. 28, 1993

[54] THREE ZONE MULTIPLE INTENSITY REFINER

[75] Inventors: William F. Lahner, Lewisburg; Gregory R. Kohler, Williamsport, both of Pa.

[73] Assignee: Andritz Sprout-Bauer, Inc., Muncy, Pa.

[21] Appl. No.: 681,049

[22] Filed: Apr. 5, 1991

[51] Int. Cl.[5] ..... B02C 7/12

[52] U.S. Cl. ..... 241/28; 241/146; 241/259.1; 241/261.3; 241/297

[58] Field of Search ..... 241/261.2, 261.3, 146, 241/28, 297, 298, 259.1

[56] References Cited

U.S. PATENT DOCUMENTS

| | | | |
|---|---|---|---|
| 2,864,562 | 12/1958 | Eberhardt et al. . | |
| 3,441,227 | 4/1969 | Fisher . | |
| 3,448,934 | 6/1969 | Vauchan | 241/146 |
| 3,790,092 | 2/1974 | Reinhall | 241/38 |
| 4,090,672 | 5/1978 | Ahrel | 241/261.1 |
| 4,221,631 | 9/1980 | Hellerqvist et al. | 162/23 |
| 4,253,613 | 3/1981 | Reinhall | 241/16 |
| 4,253,857 | 3/1981 | Fisher | 55/400 |
| 4,269,365 | 5/1981 | Berggren | 241/152 A |
| 4,283,016 | 8/1991 | Reinhall | 241/21 |
| 4,378,092 | 3/1983 | Reinhall | 241/16 |
| 4,725,336 | 2/1988 | Fisher | 162/261 |
| 4,754,935 | 7/1988 | Gullichsen | 241/24 |
| 4,921,400 | 5/1990 | Niskanen | 415/169.1 |
| 5,167,373 | 12/1992 | Bohn et al. | 241/28 |

FOREIGN PATENT DOCUMENTS

| | | | |
|---|---|---|---|
| 1-097294 | 4/1989 | Japan | 241/297 |
| WO88/03189 | 5/1988 | PCT Int'l Appl. . | |

*Primary Examiner*—Mark Rosenbaum
*Assistant Examiner*—John M. Husar
*Attorney, Agent, or Firm*—Chilton, Alix & Van Kirk

[57] ABSTRACT

A pressurized disc refiner and associated method, in which three distinct refining zones (42, 44, 46) are provided within one refiner unit (10). The refining intensity is independently controllable in each zone, in part as a result of the selective separation and redirection of steam and partially refined fibers that are discharged from the first refining zone (42) into a first separation region (68). Centrifugal force in the first separation region preferentially directs all or most of the fibers into the second refining zone (44) and an axially directed pneumatic force directs steam into a second separation region (74) on the back side of the disc. Additional separation of steam and partially refined fiber in the second separation region directs the fiber to the third refining zone (46) and draws steam directly out of the housing. A specially adapted first disc plate (14) facilitates the separation in the first separation zone (68).

24 Claims, 3 Drawing Sheets

THREE ZONE MULTIPLE INTENSITY REFINER

BACKGROUND OF THE INVENTION

The present invention relates to disc refiners, and more particularly, to disc refiners of a type that have multiple refining zones within a single refining casing.

U.S. Pat. No. 2,864,562, issued on Dec. 16, 1958 to L. E. Eberhardt et al and entitled "Plural Stage Disc Mill With Back Pressure Control Means For Each Stage", discloses a conventional technique for obtaining two refining "passes" through a single refiner, by first passing the feed stock through a refining zone on the front face of the disc, extracting the partially refined material out of the casing and then reintroducing the partially refined material at the entrance of a second refining zone at the backside of the disc.

Current theory indicates that refining intensity, i.e., the specific refining power or energy per impact of the fiber in the refining zone, is a dominant factor for optimizing and controlling the quality of fiber produced in the refining process. While the refining intensity of various refiner concepts presently available varies over a wide range, the intensity range that any given refiner can operate through is extremely limited. Therefore, pulp properties cannot be significantly modified after the basic refiner type has been selected. Furthermore, the range of practical refining intensities is restricted as a result of material feeding and steam removal limitations. Steam removal is a significant consideration, because, particularly in modern, high speed, high consistency refiners, considerable steam is generated within the refining zone as a result of the heat and friction experienced by the material during refining. The steam itself must be removed, and the influence of steam pressure within the casing must be accommodated.

SUMMARY OF THE INVENTION

It is an object of the present invention to provide control of refining intensity in at least two distinct refining zones, including steam separation between zones, within a single refining casing.

It is another object of the present invention to provide control of the refining intensity in three distinct refining zones within a single refiner casing.

It is a further object of the invention to provide steam removal and internal fiber classification within a refiner casing that has three distinct refining zones.

It is yet another object of the invention to provide an improved refiner disc by which the previously mentioned objects can be achieved.

In the broad apparatus embodiment of the invention, a disc refiner includes a shaft supported for rotation about an axis, and a single disc mounted on the shaft for rotation therewith, the shaft having axially opposed front and back sides. Relatively stationary front and back walls are spaced from the respective front and back sides of the disc, so that the walls and sides have grinding surfaces defining three distinct refining zones. The partially refined material discharged from the first zone is divided and conveyed within the casing, to the entrance of each of the other two refining zones. Preferably, two refining zones are situated on the front face of the disc, and the third refining zone is situated on the back face of the disc. A separation region between the first and second refining zones is in fluid communication with a passageway through the disc, whereby a portion of the material from the first refining zone is introduced into the second refining zone and the other portion of the material is conveyed through the passageway to the entrance of the third refining zone. The third refining zone may optionally be omitted, or function merely to provide a pressure control seal.

More particularly, chips or fibers are fed to the inlet of the first refining zone by a ribbon feeder. At the discharge of the first refining zone, steam and fiber are mechanically separated so that excess steam produced in the first refining zone, as well as back flow steam from the second refining zone, are conveyed through the rotating disc to the back side thereof. The pressure at the discharge of the first refining zone can be controlled above or below the inlet pressure to the first refining zone. By adjusting this pressure differential, the intensity of refining in the first zone can be adjusted. Furthermore, by adjusting the flow of steam that is discharged out of the casing downstream of the entrance to the third refining zone, on the back side of the disc, a portion of the fiber discharged from the first refining zone can be drawn through the passage in the refining disc where it is then separated from the steam and fed into the third refining zone. The balance of the pulp does not pass through the disc and is fed into the inlet of the second refining zone. Refining intensities in the second and third zones can be controlled in a variety of ways including (a) the pressure differential between the casing chamber into which the second and third refining zones discharge, and the steam exit nozzle from the casing downstream of the third refining zone, (b) the addition of dilution water between the first and second refining zones, and (c) the amount of steam separately discharged between the first and second refining zones.

The refiner disc embodiment of the invention includes a substantially annular body having substantially axially oriented passageways located radially between the axis and the circumferential outer edge of the body. A first annular grinding face is situated radially closer to the axis relative to a second annular grinding face, both of which are situated on the same side of the disc body. Radially extending bars on the first grinding face are axially offset in overlapping relation with the bars on the second grinding face, in a manner which defines a separation zone therebetween. Partially refined material discharged outwardly from the grooves in the first face into the separating zone, is directed by centrifugal force into the grooves of the second face, whereas a lower pneumatic pressure in the passageways draws steam out of the separation zone to the back side of the disc. Preferably, the radially outer perimeter of the first grinding face is serrated, and the passageways in the disc are radially positioned at the serrations, to facilitate the separation.

Thus, the present invention includes a variety of novel features including providing at least two and preferably three distinct refining zones within a single refiner, which affords the potential for complete refining to the ultimate pulp and product, in a single stage refining unit. Also, both the steam and fiber are separated between refining zones mechanically, with the ability to control the pressure differentials across multiple refining zones in a single refiner unit. Moreover, this arrangement provides pneumatic fiber classification within the refiner.

Other advantages resulting from implementation of the invention, include a reduction in thrust due to the evacuation of steam during the intermediate refining stages. This permits better feeding due to less steam at the refining zone inlets. Higher throughput is potentially available due to the improved steam handling. Higher strength pulp may also be achieved, due to lower intensity refining that results from steam removal. Moreover, the refining intensity can be controlled by steam flow. Significant energy savings can be achieved as a result of the pneumatic classification and intermediate removal of developed fibers. In addition, greater flexibility, particularly in turndown situations, is available.

DESCRIPTION OF THE DRAWINGS

These and other objects and advantages of the invention will be described below with reference to the preferred embodiment taken in conjunction with the accompanying in which.

DESCRIPTION OF THE PREFERRED EMBODIMENT

Figure 1:
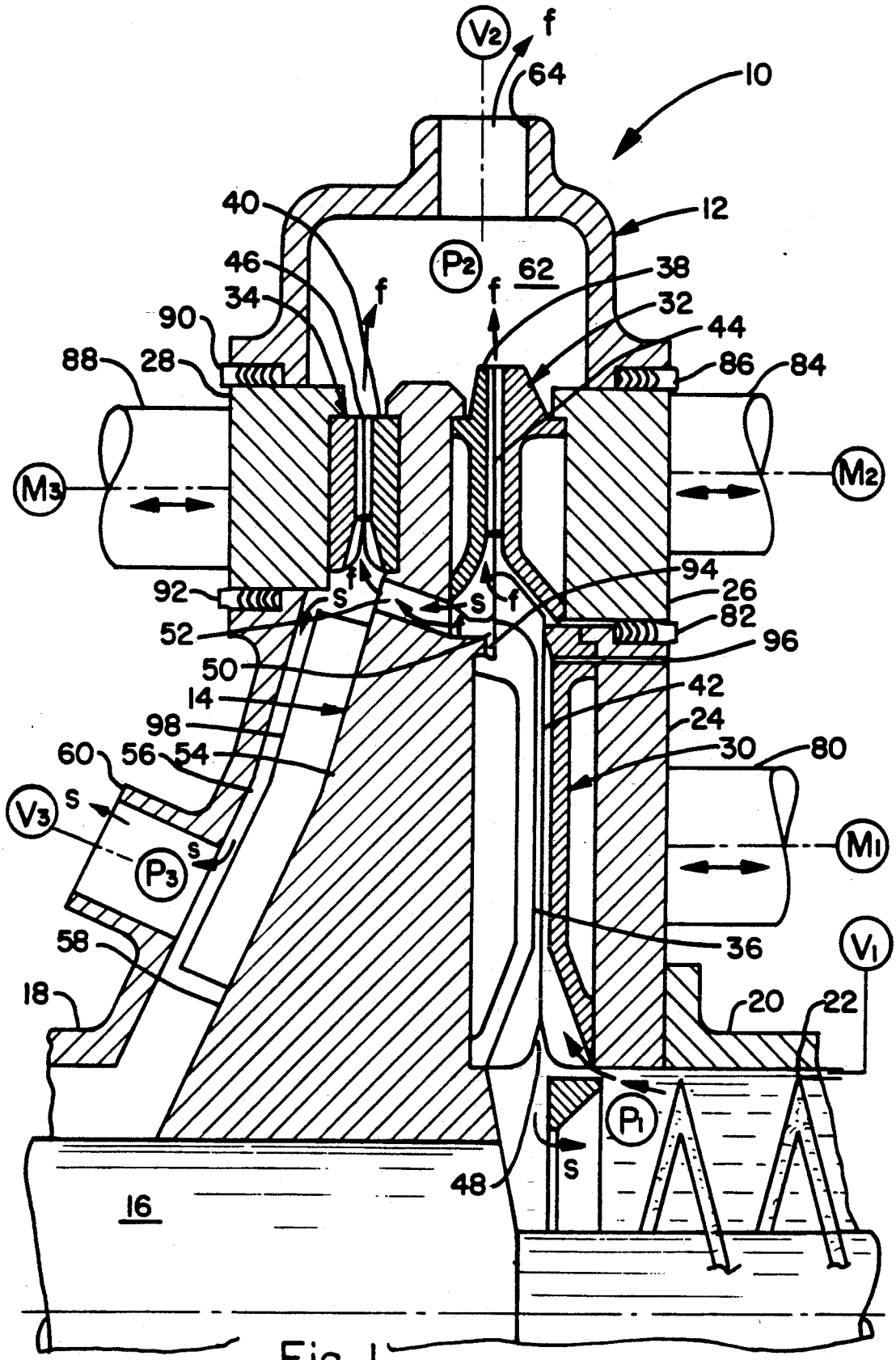
FIG. 1 a section view of the portion of the refiner containing the multiple refining zones in accordance with the present invention.

FIG. 1 is a sectional view of one-half of a portion of a disc refiner 10, illustrating the preferred embodiment of the invention. The type of refiner 10 in which the invention is most beneficial, is based on the design described in, for example, U.S. Pat. No. 2,864,562 issued to L. E. Eberhardt et al on Dec. 16, 1958, entitled "Plural Stage Disc Mill With Back Pressure Control Means For Each Stage". A more recently commercialized version of the basic prior art refiner design, is available from Andritz Sprout-Bauer, Inc., Muncy, Pa., and is known as the Twin 60 and SB 150 Single. In these types of refiners 10, a casing 12 contains a disc 14, having a diameter typically greater than 30 inches, mounted on a rotatable shaft 16. A shaft housing 18 surrounds the shaft and is sealingly connected to or an integral portion of casing 12, whereby a higher pressure can be established and maintained within the refiner 10, relative to the ambient atmospheric pressure. In the embodiment shown, the shaft 16 is typically driven at or above 1200 rpm by a motor or other source of power at the left (not shown).

On the right, a feeder housing 20 contains a feed screw 22, typically of the ribbon-type shown in, for example, U.S. Pat. No. 3,441,227, issued to C. D. Fisher on Apr. 29, 1969, entitled "Refiner Feeder". The feeder housing 20 is connected to a first wall 24 which in turn is connected to a second wall 26. The walls 24 and 26 in effect define the front portion of the casing 12. The back portion of the casing preferably includes a third wall 28 interposed between the shaft housing 18 and the outer portion of casing 12.

The first wall 24 has a first static grinding plate 30 secured thereto, and, likewise, the second wall 26 has a second static grinding plate 32 secured thereto. Similarly, the third wall 28 has a third static plate 34 secured thereto. A first disc plate 36 is carried on the front portion of the body 54 of the disc 14, in close opposition to the static plate 30. A second disc plate 38 is carried at a radially outer portion of the disc body 14, in opposition to the second static plate 32. Similarly, the back side of the radially outer portion of the disc body 54 includes a third disc plate 40 in opposition to the third static plate 34.

These three sets of opposed plates 30, 36; 32, 38; and 34, 40, define a respective first refining zone 42, second refining zone 44, and third refining zone 46, through which material to be refined passes radially outward between the relatively rotating, opposed plates. As is well known in this art, material to be refined is delivered to the throat 48 of refining zone 42, by means of the feed screw 22. The material passes radially through the first refining zone 42, where attrition occurs, with the generation of steam due to the heat created by friction.

Figure 2:
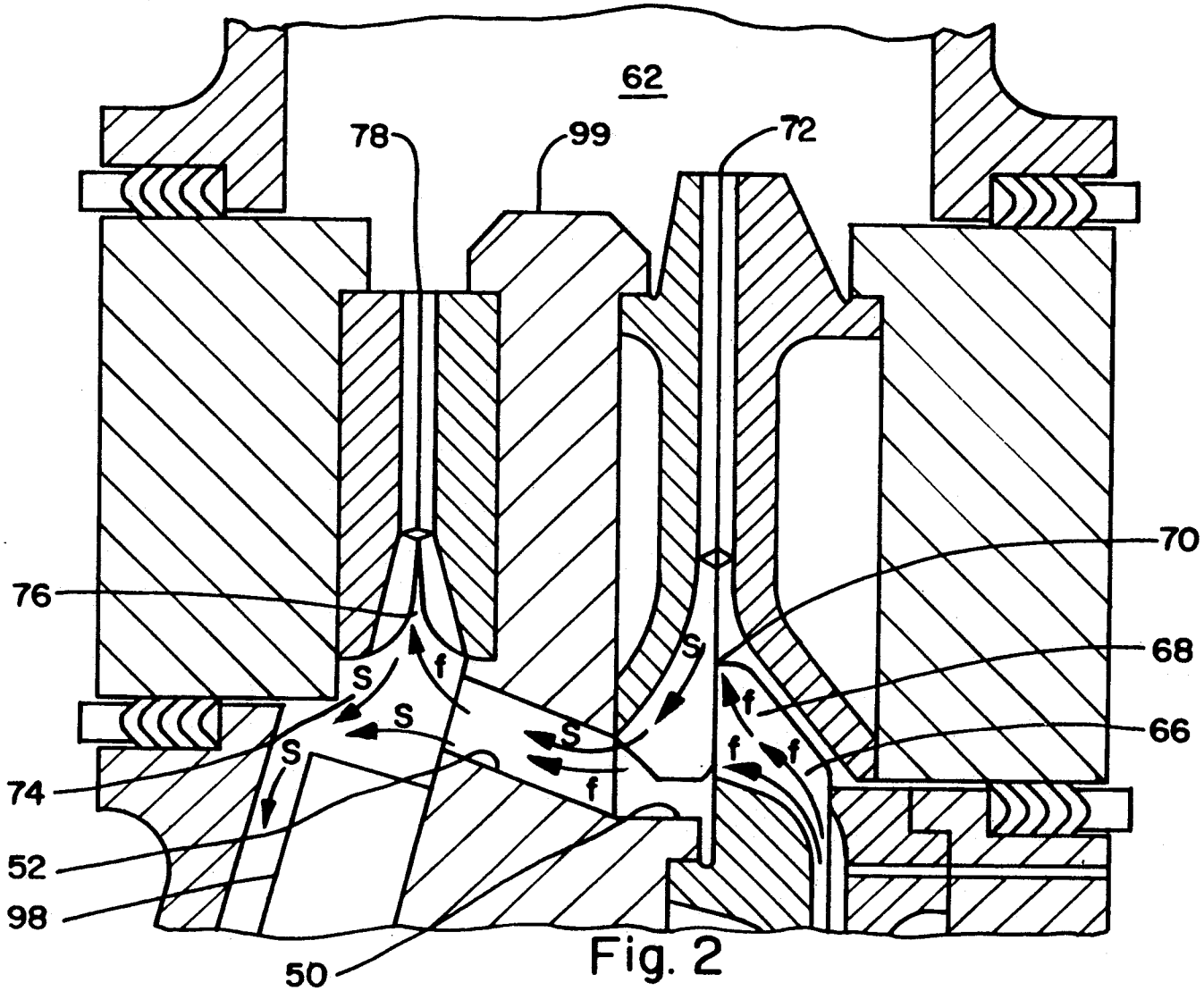
FIG. 2 is an enlarged view of the flow paths of the steam and fibers between refining zones in the embodiment shown in FIG. 1.

The path of material and steam flow are described in greater detail with further reference to FIG. 2. Some of the steam is withdrawn from the refiner 10 via backflow through the feed screw 22, as indicated by the arrow labeled with an "S" in FIG. 1, whereas the remaining steam passes with the refined material outwardly from the first refining zone 42 into the entrance area of the second refining zone 44. An opening 50 is provided in the front face of the disc in the vicinity of the exit of the first refining zone 42, whereby steam, indicated by the arrows labeled "S", is drawn away to the back side of the disc while the partially refined material, typically in the form of partially attrited fibers, pass into the entrance area of the second refining zone 44. As in the first refining zone 42, steam is generated as a result of the attrition process in the second refining zone 44, but some of this steam joins with the steam exiting from the first refining zone to enter opening 50. The disc is provided with a passageway 52 extending axially through the disc body 54, and preferably extending obliquely upward from the front to the back sides.

Thus, chips or fiber are fed to the throat 48 of the first refining zone 42 in the normal manner. At the discharge 66 of the first refining zone, in a front separation region 68, steam and fiber are mechanically separated so that excess steam produced in the first refining zone (as well as back flow steam from the second refining zone 44) is extracted through the rotating disc via opening 50 and passageway 52. The disc back side 58 and the passageway 52 leading thereto, are in fluid communication with a steam outlet 60 which is at a pressure P3 which can be lower or higher than P1 at the throat 48 of the first refining zone 42. The arrow labeled "S" shows the flow of steam from passageway 52, along a channel 56 formed in part by the shaft housing 18, into the steam outlet 60 which is also preferably formed in the shaft housing 18.

The radially outer, or exit ends of the plates defining the second and third refining zones 44, 46, are both exposed to the fiber outlet chamber 62 formed by casing 12, surrounding the circumference of disc 14. The pressure P2 in outlet chamber 62 can be higher or lower than pressure P1 at throat 48, and less than the steam outlet pressure P3 at steam outlet 60.

Each of the pressures P1, P2 and P3, is controllable in accordance with the present invention, by respective valves V1, V2 and V3, or equivalent means for adjusting the flow rates and/or pressures through the respective throat 48, fiber outlet 64 which is fluidly connected to the outlet chamber 62, and steam outlet 60. Refining intensity can be changed by adjusting the difference between P1 and P3 as well as P3 and P2. Due to the refining process, a pressure exists at a point in each refining zone that is higher than the inlet or discharge portion of the zone. Thus, the pressure P3 at the exit 66 of the first refining zone can be controlled above or below the inlet or entrance pressure P1 at the first refining zone. By adjusting this pressure differential, the intensity of refining in the first zone 42 can be adjusted.

Furthermore, by adjusting valve V3 to adjust the flow of steam that is discharged through outlet 60, a portion of the fiber discharged from the first refining zone 42 can be drawn through the opening 50 and passageway 52 in the refiner disc where upon it is separated from the steam and fed into the entrance 76 of the third refining zone 46. The balance of the partially refined pulp that has been discharged at the exit 66 of the first refiner zone, does not pass through the disc via passageway 52, but rather is introduced to the entrance 70 of the second refining zone 44. The refining intensities in the second and third refining zones 44, 46, are controlled by the pressure differential between P2 in chamber 62, and P3 in steam outlet 60.

Further adjustment of intensity is provided by controlling flow through water line 96 in the upper portion of front wall 24. The amount of dilution water added through line 96 adjacent the exit of the first zone 66, i.e., between the first and second refining zones 42, 44, affects the separation efficiency in the first separation region 68 and the fiber retention or dwell time in refining zones 44 and 46.

Figure 3:
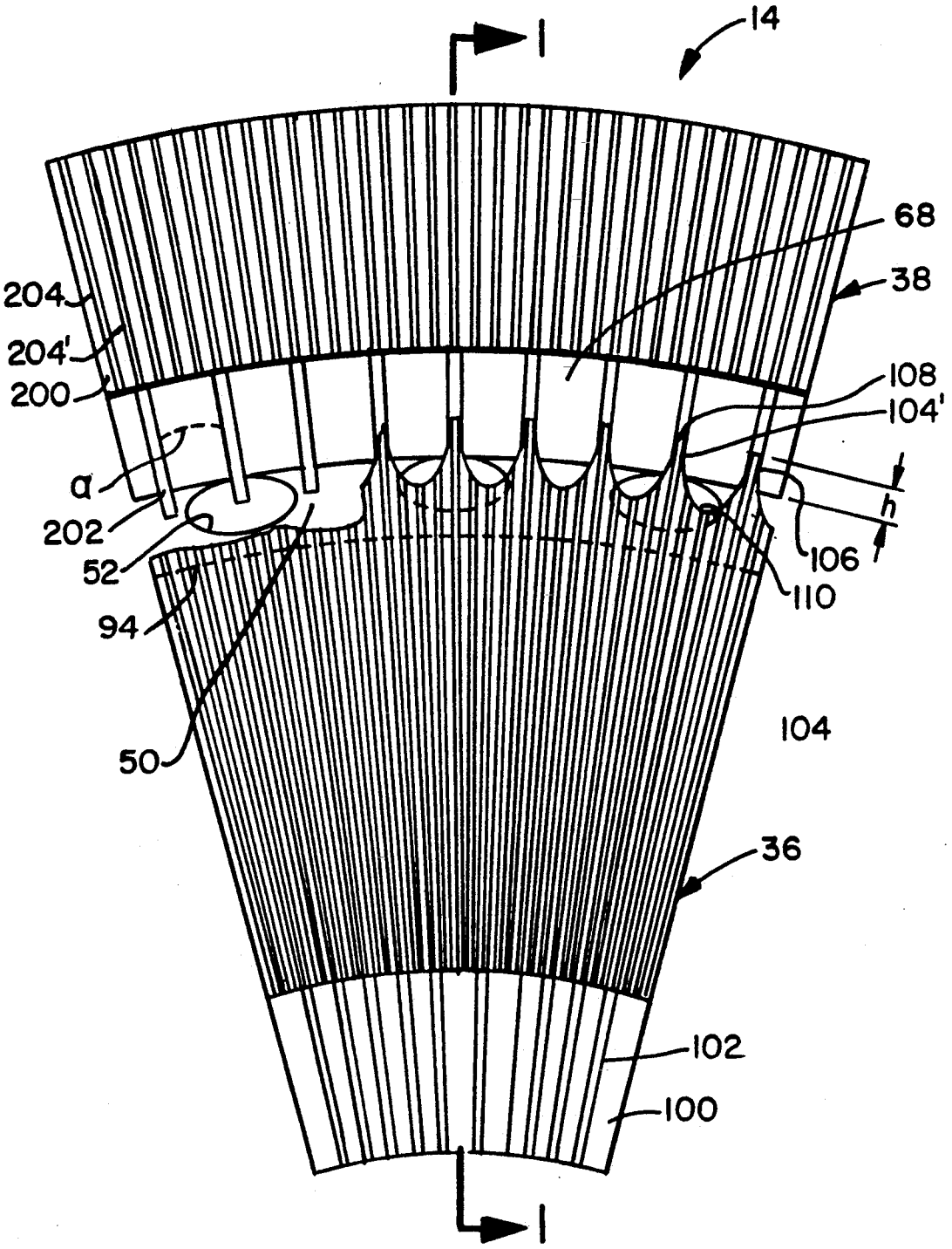
FIG. 3 is an elevation view of a sector of the plates carried on the front face of the disc in the embodiment shown in FIGS. 1 and 2.

FIGS. 1, 2 and 3 show four of the most important novel features of the present invention. First, three distinct refining zones 42, 44, 46 are contained within a single refiner 10, and more particularly, within one casing 12 of a refiner. The three refining zones are, in the illustrated embodiment, simultaneously effectuated by the rotation of a single disc 14, with two of the refining zones 44 and 46 on one side of the disc, and the other refining zone on the opposite side of the disc.

The second important feature is that steam and partially refined fiber are mechanically separated between refining zones. In particular, steam and fiber are separated in the front separation region 68 between the discharge 66 of the first refining zone and the entrance 70 of the second refining zone. The details of the mechanical separation will be discussed below with particular reference to FIG. 3. The pneumatic separation of fiber and steam is also accomplished in the back separation region 74 immediately upstream of the entrance 76 to the third refining zone 46.

Another important feature is the ability to control pressure differentials across multiple refining zones within a single refiner. Thus, the pressure difference between P1 and P3 as adjusted by valves V1 and V3, controls the pressure differential across first refining zone 42. The pressure differential across second refining zone 44 is controlled by adjusting valve V3 to control pressure P3, by the back pressure P2 maintained by valve 43. Finally, the pressure differential across the third refining zone 46 is controllable by adjustment of the pressure P3 by valve V3, and P2 by valve V2.

The fourth significant novel feature is pneumatic fiber classification within one refiner. In the illustrated embodiment, the fibers discharged from the first refining zone at 66, are classified into relatively heavy or larger fibers which continue radially outward into the entrance 70 of the second refining zone 44 due to their greater momentum than the smaller or relative lighter fibers which are influenced to a greater extent by the lower pressure in passageway 52 and are therefrom diverted away from the second refining zone 44 toward the entrance 76 of the third refining zone 46.

It should also be appreciated that the pressure within and across each refining zone 42, 44, and 46, can be independently adjusted by the adjustment of the gap between refining plates in conjunction with power application, as a result of the adjustment of the static plates 30, 32 and 34 toward or away from the rotating disc plates 36, 38 and 40, respectively. This is accomplished by an adjusting member such as the rod or the like 80 connected to first wall 24, as actuated for axial movement by a motor M1 or the like. A chevron or similar seal 82 is provided between the first wall and second wall 26, which is similarly axially adjustable by means of the second adjusting member 84 and associated motor or equivalent adjustment means M2. The second wall is preferably sealingly mounted to the top of casing 12, by means of chevron seal 86. In a similar manner, the third wall member 88 on the back side of the disc, may be moved axially by means of the third adjustment member 88 and associated motor M3, while maintaining sealing engagement with the casing member 12 and shaft housing 18 by means of the chevron seals 90 and 92.

Although this pressure adjustment is somewhat indirect, the primary purpose of adjusting the plate gap is to influence the intensity of the refining independently of the pressure differential across the refining zone. As is well known, intensity is commensurate with the energy imparted to the pulp or other material to be refined, per impact experienced by the material as a result of being "squeezed" between the ribs which cross each other at high frequency as the plates rotate relative to each other. At a given speed of relative rotation, the energy associated with each impact is dependent on the axial spacing between the plates. The total number of impacts experienced by a given unit volume of material depends on the duration of time during which the material is situated in the refining zone. It may thus be appreciated that the total refining effect achieved in a given refining zone can be influenced by adjustment of the refining plate gap, by means of adjustment members 80, 84, and 88, and/or by the residence time in the refining zones, which is controllable by the adjustment of the differential pressure across each zone.

In practice, plate gap is adjusted almost continually to control applied power. The adjustment of differential pressures between P1, P2 and P3 by means of valves V1, V2 and V3, can nevertheless be affectuated on line, during operation of the refiner, to optimize the refiner output. Such on-line intensity control may also include a dedicated control system including any level of control logic, including feedback (not shown).

It should be appreciated that the nature of the refining performed in refining zone 44 would normally be somewhat different from the refining performed in the third refining zone 46, because the partially refined fibers entering the second zone 44 are somewhat different, e.g., larger or heavier, than the partially refined fibers entering the third refiner zone 46.

In the preferred embodiment, the entrance 76 to the third refining zone 46 on the back side of the disc, is preferably radially farther from the shaft axis than is the discharge 66 from the first refiner zone 42. As mentioned above, some of the fiber discharged at 66, is conveyed through the body 54 of disc 14, to the vicinity of entrance 76, preferably by the passageway 52, which also defines a flow path for steam generated in the first and second refining zones 42, 44, to pass to the back side 58 of disc 14. The steam outlet 60 is preferably formed in the shaft housing 18, but could alternatively be formed in the casing in configurations other than the illustrated embodiment, at a position between the passageway 52 and the shaft axis.

In the preferred embodiment illustrated in FIGS. 1 and 2, the separation of fiber and steam is accomplished with a novel adaptation of the concept described in U.S. Pat. No. 4,725,336 issued on Feb. 16, 1988 to C. Donald Fisher and entitled "Refiner Apparatus With Integral Steam Separator", the disclosure of which is hereby incorporated by reference. The '336 patent discloses an arrangement whereby a mixture of fiber entrained in steam exits a refiner zone along the front face of a rotating disc, with most of the steam and substantially all of the fiber being extracted radially from the casing, and with a portion of the steam being separated at the backside of the rotating disc and withdrawn from the casing through a separate passageway. Separation of fiber and steam is accomplished by providing a plurality of fins on the backside of the disc, and maintaining a pressure differential radially along the fins, whereby the fins generate a radially outward, centrifugal force that tends to keep fibers out of the fins, whereas the pressure differential induces the steam to flow radially through the fins toward the discharge passageway.

According to applicant's novel adaptation as shown in FIG. 2, the steam and entrained fibers which enter the second separation zone 74 through passageway 52, are influenced by the rotation of the plurality of radially extending fins 98 on the backside 54 of the disc body 58. Any fibers which are carried by the flow into the space between the fins 98, are thrown radially outwardly by centrifugal force toward the entrance 76 to the third refining zone. On the other hand, so long as the pressure P3 is maintained below the pressure in the second separation zone 74, the steam, which is not influenced by centrifugal force to the extent of fibers, passes radially inward along channel 56 to be extracted from the casing through nozzle 60.

Unlike the arrangement shown in the '336 patent, however, with applicant's invention as shown in FIG. 1, the steam and entrained fiber which is discharged from the first refining zone 42, does not pass radially outward from the outer edge 99 of the rotating disc 14 into plenum 62, before separating action occurs. Rather, a first separation zone 68 is provided at a radially intermediate location along the disc 14, such that some of the steam and fiber is introduced into a second refining zone 44 on the same side of the disc as the first refining zone, but radially outward therefrom, and some of the steam, and optionally some of the fiber, is diverted at the first separation zone through passageway 52 to the second separation zone 74 on the backside of the disc.

It should be appreciated that, although the preferred embodiment as described above provides for three refining zone in each of which significant refining intensity is achieved, the invention may optionally be implemented so that significant refining action is achieved only in the first and second refining zones 42, 44. In this embodiment, a seal ring is provided at the location of the plates 34 and 40 to prevent significant flow of steam radially on the backside of the disc from passageway 52 into plenum 62. Providing such a seal using refiner plates with very simple confronting faces, kept at very close gap clearances, is well known in this field in other contexts. In this simplified embodiment where no significant refining action occurs in the third zone 46, which effectively functions only as a seal, the pressures and other parameters would be controlled to minimize the flow of any fiber through passageway 52. Any unwanted fiber appearing in separation zone 74 would not follow the steam downwardly through channels 56 because of the effect of centrifugal force from the rotating fins 98. Rather, the fibers would find their way into the entrance 76 of the third refining zone and pass radially through the refining zone 46 into plenum 62. In the particular embodiment where the third refining zone 46 is intended to function only as a seal, the properties of any fibers passing therethrough would not be significantly altered relative to their condition in the first separation zone 68, whereas in the preferred embodiment, these fibers would be further refined.

Whether the implementation of the invention is in the preferred mode, with three distinct refining zones in which the fibers are attrited, or whether only two effective refining zones are provided, the invention provides, for the first time, the separation of partially refined fiber from steam at a radial position intermediate the axis and outer edge 99 of the disc 14. The separated fibers flow predominantly radially outwardly toward the edge 99, and the separated steam flow predominantly axially through the disc.

FIG. 3 is an elevation view of a sector of the grinding faces of the first disc plate 36 and second disc plate 38 adapted to mechanically separated steam and partially refined fiber between the first and second refining zones 42, 44. The cross sectional representation of the disc body 54, opening 50, passageway 52, and first and second disc plates 36, 38 are shown in FIGS. 1 and 2, as viewed along section line A—A of FIG. 3.

In FIG. 3, the first disc plate 36 has a body portion 100 which is connected to the disc body 54, and which carry two types of radially extending, rigid bars 102, 104. The lower, coarse bars 102 as depicted in FIG. 3, are relatively thicker and spaced apart farther. The upper bars 104 on the first disc plate 36, are each somewhat thinner, but have a higher density, than the lower bars 102. The radially outer extremity of the first base 100 is serrated as shown at 106, i.e., consists of a regular sequence of peaks 108 and valleys 110, each of which has an amplitude designated as h in FIG. 3. The upper bars 104 include longer bars 104' extending on a radius passing through each peak 108, and three shorter bars are situated in the valleys between the longer bars 104'. The spaces between peaks 108, in effect define the discharge or exit 66 from the first refining zone 42.

As shown in FIG. 1, the first static plate 30 confronts the first disc plate 36, and has a substantially similar array of bars confronting the bars 102 and 104, except that the longer bars are slightly shorter than bars 104, i.e., they confront bars 104 to a radial position slightly below the valleys 110. It may also be observed in FIG. 1, that, in cross section, the lower portion of the first base 100 is angled obliquely so that, in cooperation with the corresponding portion of the first static plate 30, a generally funnel-shaped entrance is defined at throat 48. The lower portion of the second disc plate 38, in conjunction with the opposed portion of the second static plate 32 defines a funnel-like entrance to the second refining zone 44.

As shown in FIG. 3, the lower edge of the second base 200 of plate 38 overlaps the upper bars 104' of the base 100. The lower, coarse bars 202 on the second base 200 are analogous to the lower bars 102 on first base 100 in that they are relatively thick and relatively farther spaced apart, than are the upper bars 204'. In the embodiment shown in FIG. 3, an upper spoke 204 is radially aligned with each lower spoke 202 on second base 200, and three additional upper bars are situated between the radially aligned bars 204'. The spaces between bars define radial grooves through which material moves radially outward.

Inspection of FIGS. 1 and 3 reveals that the second refining zone 44 is axially displaced from the first refining zone 42 by a distance approximately equal to the axial dimension of the longer bars 104'. Furthermore, the lower portions of the coarse bars 202 extend below the lower edge of the second base 200 and overlap with the upper ends of the longer bars 104'. As shown in FIG. 1, an annular groove 94 may be present due to manufacturing convenience and opens radially outwardly in the upper portion of the first base 100 with the forward wall of the groove extending vertically substantially in alignment with the second refining zone 44. Like the groove 94, opening 50 extends annularly around the disc body 54 and is situated between the front separation region 68 and the passageway 52. The front separation region can generally be described as the region of overlap between the first and second disc plates 36, 38, and more particularly, at the overlap of the bars 104 and 202. The opening 50 is in fluid communication with a plurality of discrete, annular spaced apart passageways 52, preferably having an oval or elliptical cross section, which passes from the front to the rear of the disc body.

The particular arrangement of first and second disc plates 36, 38 shown in FIGS. 1-3 mechanically separates the steam and partially refined pulp in the following manner. As the steam-fiber mixture passes radially through the grooves between bars 104, additional steam is generated due to the refining action on the fibers. First and second base 100 are rotating at the same rate as the disc 14, i.e., base 200 is not rotating relative to base 100. As the fibers and steam exit the grooves between bars 104 at the scalloped edge 100, centrifugal force throws the fibers radially outward and, to the extent they have any tangential component, the fibers contact the sides of the long bars 104 and continue their radially outward movement along the bars.

The pressure in each passageway 52 is less than the pressure in the separation zone 68 where, for a brief moment, the fibers and steam are relatively unconfined as compared with their travel between bars 104. The lower pressure in passageway 52 diverts the steam axially into the passageway, wherein the fiber may be deflected slightly axially, but nevertheless continues to move under the influence of centrifugal force into the space between bars 202 and subsequently continues to move radially in the grooves between bars 204.

Thus, in general, any steam present in the vicinity of the separation zone 68 is influenced more by the pressure differential enters passageway 52, whereas any fiber in the separation zone 68 is influenced more by centrifugal force and passes radially outwardly. Centrifugal force throws the fiber radially outward into the entrance 70 of the second refining zone 44, aided by the raised structures 106, 102 and 202. This is opposed by the pneumatic force of steam trying to convey the fiber through holes 50 and passageways 52 toward the low pressure at P3. The passageways 52 are radially close enough to the separation zone 68, so that it is possible to deliberately draw some of the fiber in the separation 68 into passageway 52 for further refining in the third refining zone 46. Similarly, pressure and other control can be applied to direct all the fiber from the separation zone 68 into the second refining zone 44, with only steam conveyed through passageway 52.

As described above, to the extent fiber is present in the second separation zone 74, the fins 98, which rotate in unison with the base 100 and 200, produce a centrifugal force at their radially outer edge which tends to prevent the fibers from flowing through channels 56 toward steam outlet 60, and instead the fibers are thrown toward the inlet 76 of the third refining zone 46.

Although variations of these two plates will also fall within the scope of the present invention, it is believed that the long bars 104' of the first plate 36 and the coarse bars 202 of plate 38, should be separated by the same angle, alpha, in the range of 5°-10°. Also, the height h of each peak 108 should be approximately equal to the extent of the overlap between the plates 36, 38 and approximately equal to the minor diameter of each passageway 52. Preferably, at least about ten passageways 52 are provided in an annular pattern around the disc body 54, between opening 50 and the entrance 76 to the third refining zone.

What is claimed is:

1. A disc refiner for processing material comprising:

a shaft supported by rotation about an axis;

a single disc mounted on the shaft for rotation therewith, the disc having axially spaced front and back sides;

relatively static front and back walls axially spaced from the respective front and back sides of the disc, said walls and sides having grinding surfaces selectively mounted thereon so as to define three distinct refining zones each of which receives, processes and discharges material;

means associated with the disc for dividing and conveying the material discharged from one of the three refining zones, to each of the other two refining zones, said means for conveying including at least one passageway from the front to the back side of the disc; and means for controlling the proportion of the discharge of the material from said one refining zone that is conveyed to each of the other two refining zones, said means for controlling including means for independently controlling the pressure in the refiner upstream of the first refining zone and in said passageway.

2. The disc refiner of claim 1, wherein the means for controlling the pressure includes second means, for controlling the pressure in the refiner downstream of the other two refining zones.

3. A disc refiner, comprising:

a rotatable shaft;

a rotary disc mounted on said shaft for rotation therewith and having front and back grinding surfaces on respective front and back sides of the disc;

relatively static front and rear plates in respective opposing spaced relation to the front and back grinding surfaces of said disc;

means for adjusting at least one of said front and rear plates to vary the spacing between said one plate and the opposed grinding surface on said disc;

means for directing all the material to be refined radially between said disc and one of said front and rear plates for partial refining of the material and then directing at least some of the partially refined material through the disc to the opposite side of the disc and radially between the opposite side of the disc and the other of said front and rear plates;

a third grinding surface mounted on the disc and an associated spaced apart, third stationary plate, located at the same side of said disc as said one plate;

wherein said means for directing includes means for directing some of the partially refined material from said one plate to said third plate;

means for controlling the pressure upstream of said one plate;

means for controlling the pressure in said passage; and means for controlling the pressure downstream of said other plate.

4. The disc refiner of claim 3, wherein the means for controlling the pressure downstream of said other plate simultaneously controls the pressure downstream of said opposite plate.

5. In a disc refiner including a rotatable shaft situated in a housing, a rotating disc situated in a casing and mounted on said shaft for rotation therewith, the disc having front and back grinding surfaces on its opposite sides, front and back relatively static plates in opposing relation to the respective front and back grinding surfaces of the disc to define respective front and back refining zones therebetween, feeder means for introducing feed material to be refined into the casing, and outlet means for directing refined material exiting from the front and rear refining zones out of the casing, wherein the improvement comprises:

said front refining zone includes a first refining zone located relatively near the shaft and into which the feed material is introduced, said first refining zone being defined by a first grinding surface on the front side of the disc and an opposed first stationary plate, and a second refining zone located relatively farther from the shaft and defined by a second grinding surface on the front side of the disc and an opposed second stationary plate, said first and second refining zones being radially spaced apart and distinct from each other;

said disc includes means formed between the first and second refining zones for conveying one portion of the partially refined material exiting from the first refining zone into the second refining zone, and conveying another portion of the refined material exiting the first refining zone into the back refining zone;

said outlet means directs refined material exiting from the second refining zone and the back refining zone out of the casing; and wherein each refining zone has a radially inner entrance and associated entrance pressure and a radially outer exit and associated exit pressure, and the improvement further comprises means for independently adjusting the entrance pressure of the first refining zone, and the entrance pressure of the back refining zone.

6. The disc refiner of claim 5, wherein the exit of the second refining zone and the exit of the back refining zone are at the same pressure defined by the pressure in a common chamber within the casing, and the improvement further comprises means for adjusting the pressure in the chamber independent of said means for adjusting the entrance pressures.

7. The disc refiner of claim 5, further including means for moving each of the first, second and back stationary plates toward and away from the first, second and back grinding surfaces, respectively, for independently adjusting the plate gap between opposed plates.

8. The disc refiner of claim 5, wherein each refining zone has an entrance and an exit, and the entrance to the back refining zone is radially farther from the shaft axis than is the exit of the first refining zone.

9. The disc refiner of claim 8, wherein the means for conveying another portion of the refined material exiting the first refining zone is formed through the disc.

10. The disc refiner of claim 8, wherein the means for conveying the portion of the refined material exiting from the first refining zone through the disc, is in the form of a plurality of discrete passageways extending from the front of the disc adjacent the exit of the first refining zone to the back of the disc adjacent the entrance to the back refining zone.

11. The disc refiner of claim 10, wherein said passageways define flow paths for steam generated in the first and second refining zones to pass to the back side of the disc.

12. The disc refiner of claim 11, wherein nozzle means are formed in one of the housing or casing at a location that is closer to the shaft axis than are the passageways at the back side of the disc, for receiving steam from the passageway and discharging the steam from the casing.

13. A pressurized disc refiner for refining wood chips and similar feed material into fiber with integral steam separation, comprising:

a pressure housing;

a shaft mounted for rotation in the housing about a rotation axis;

a rotary disc coaxially mounted on the shaft within the housing for rotation therewith, the disc having a front side and a back side;

a first substantially radially oriented refining zone at the front side of the disc, the first refining zone having an entrance for receiving feed material at a feed pressure and an exit for discharging a mixture of steam and partially refined material;

a second substantially radially oriented refining zone at the front side of the disc, the second refining zone being distinct from the first refining zone, and having an entrance adjacent the exit of the first refining zone;

first means at the front side of the disc and rotatable therewith, for imparting a substantially radially outwardly directed centrifugal force to the mixture discharged from the first refining zone; and second means including a passageway from the front to the back side of the disc, for imparting a substantially axially directed pneumatic force on the mixture discharged from the first refining zone;

whereby the centrifugal and pneumatic forces direct at least most of the partially refined material from the first refining zone into the entrance of the second refining zone, and most of the steam from the first refining zone into the passageway to the back side of the disc.

14. The disc refiner of claim 13, including means for independently controlling the feed pressure to the first refining zone, the pressure at the exit of the second refining zone, and the pressure in the passageway at the back side of the disc.

15. The disc refiner of claim 14, including means on the back side of the disc adjacent the passageway, for separating steam and partially refined material that passes to the back side of the disc through the passageway.

16. The disc refiner of claim 15, wherein said means on the back side for separating include, a plurality of radially extending fins on the disc which rotate about the axis as the disc rotates, a pair of relatively rotating plates confronting each other at the back side of the disc so as to define a radial gap therebetween, the gap having an entrance and an exit, and means for adjusting the pressure between the entrance and exit of said gap.

17. The disc refiner of claim 16, wherein the gap is formed between opposed grinding plates which define a third refining zone in said refiner.

18. A disc for a disc refiner, comprising:

a substantially annular body having a central axis of rotation, first and second axially spaced sides extending substantially radially from the axis, a circumferential edge spanning the radially outer ends of the sides, and passageway means extending between the first and second sides at a radial position inward of the circumferential edge;

a substantially annular first grinding face coaxially formed at a radially inner portion of one side of the disc;

a substantially annular second grinding face formed at a radially outer portion of said one side of the disc;

said first grinding face having a first plurality of radially oriented bars, each having a radially inner and outer end, the bars defining a first plurality of radially extending grooves therebetween;

said second face having a second plurality of radially oriented bars, each having a radially inner and outer end, the second plurality of bars defining a second plurality of radially extending grooves therebetween;

wherein the outer ends of the bars on the first grinding face are axially offset from and in overlapped relation with the inner ends of the bars on the second grinding face.

19. The refiner disc of claim 18, wherein the radially outer perimeter of the first grinding face is substantially serrated, thereby defining a regular sequence of peaks and valleys, and wherein the outer end of each of at least some of the bars on the first grinding surface pass through a respective peak.

20. The refiner disc of claim 19, wherein the passage way means at the front side of the disc is at a radial position approximately the same as the radial position of the overlap of the bars.

21. The refiner disc of claim 19, wherein the radial position of the passageway means at the front side of the disc, is substantially the same as the radial position of the valleys on the serrated perimeter of the first grinding face.

22. A method for refining feed material between opposed, relatively rotating grinding plates in the housing of a pressurized disc refiner, comprising:

passing all the feed material through a first refining zone on one side of the disc to produce a mixture of steam and partially refined fiber in a first separation region downstream of the first refining zone;

applying a radially outward, centrifugal force and a substantially axially directed pneumatic force on the mixture, thereby preferentially directing the partially refined fiber radially outwardly and preferentially directing the steam substantially axially;

passing at least some of the partially refined fibers from the first separation region into a second refining zone situated substantially radially outward of said first refining zone;

passing at least some of the steam from the first separation region into a second region on the other side of the disc; and adjusting said pneumatic force in the first separation region to control the distribution of partially refined fibers and steam from the first separation region into said second refining zone and into said second region.

23. The method of claim 22, including the steps of, directing substantially all of any partially refined fibers in the second region into a third refining zone on said other side of the disc, and directing steam without fiber from said second region out of the housing through a conduit that bypasses the third refining zone.

24. The method of claim 23, wherein the step of adjusting the pneumatic force includes adjusting the pressure in said conduit.

* * * * *